United States Patent [19]

Okabayashi

[11] Patent Number: 5,024,744

[45] Date of Patent: Jun. 18, 1991

[54] STAMPER CLEANING APPARATUS

[75] Inventor: Norio Okabayashi, Himeji, Japan

[73] Assignee: Daicel Chemical Industries, Ltd., Sakai, Japan

[21] Appl. No.: 535,839

[22] Filed: Jun. 11, 1990

[30] Foreign Application Priority Data

Jun. 12, 1989 [JP] Japan ..... 1-149229

[51] Int. Cl.[5] ..... C25D 7/00; C25D 1/00; B08B 3/00

[52] U.S. Cl. ..... 204/194; 204/232; 204/DIG. 13; 134/61; 134/88; 134/113; 134/135; 134/198

[58] Field of Search ..... 204/141.5, 5, 232, 129.6, 204/DIG. 13, 240, 241; 134/61, 88, 113, 135, 198

[56] References Cited

U.S. PATENT DOCUMENTS

| | | | |
|---|---|---|---|
| 3,979,220 | 9/1976 | Ishiyama et al. | 204/232 X |
| 4,180,417 | 12/1979 | Oka et al. | 204/DIG. 13 X |
| 4,561,956 | 12/1985 | Antonelli | 204/232 |
| 4,592,819 | 6/1986 | Suzuki et al. | 204/DIG. 13 X |
| 4,729,940 | 3/1988 | Nee et al. | 204/129.6 X |
| 4,746,414 | 5/1988 | Carpenter et al. | 204/DIG. 13 X |
| 4,772,357 | 9/1988 | Carlson et al. | 134/61 X |
| 4,966,673 | 10/1990 | Accattato | 204/241 X |

*Primary Examiner*—Donald R. Valentine

*Attorney, Agent, or Firm*—Cohen, Pontani & Lieberman

[57] ABSTRACT

A stamper cleaning apparatus comprises an electrocleaning tank for performing electrodegreasing, a washing room adjacent to this cleaning tank, a shower, disposed in the upper section of the washing room, for water-washing a stamper by spraying washing water onto the stamper while the stamper is positioned inside the washing room and is wet with an electrocleaning solution, a water drain tank, disposed in the lower section of the washing room, for collecting water after the stamper is washed with water and for draining the water, and a small drying room disposed in the upper section of the washing room for operating to heat and dry the stamper after the shower has operated during the predetermined time the stamper is held in the washing room.

11 Claims, 6 Drawing Sheets

STAMPER CLEANING APPARATUS

BACKGROUND OF THE INVENTION

1. Field of the Invention

The present invention relates to a stamper cleaning apparatus and, in particular, to a stamper cleaning apparatus for electrocleaning, washing with water and drying a stamper used to mold optical discs.

2. Description of the Related Art

A master board such as a stamper for use in the manufacture of discs for recording information, e.g., LP disks or optical discs, is generally manufactured in the following process.

First, an original glass board is polished. A light-sensitizing resin film is applied to the polished surface and optical etching is performed to form a desired fine pattern. Next, a thin metal film is disposed on the fine pattern surface and a covering is made of a desired thickness by electroplating with nickel. Then the covering is separated from the original glass board and a stamper is made.

However, a light-sensitizing resin film remains on the surface of this stamper. To remove this film, the following methods have been adopted: (1) an electrodegreasing cleaning method which performs electrodegreasing in a solution mixed with an alkali/surface active agent, (2) an ultrasonic cleaning method which cleans in an organic solvent using ultrasonic waves, and (3) a cleaning method that is a combination of these methods (Japanese Patent Laid-Open No. 62-214535).

Unlike conventional LP records, information recording discs and optical discs which retrieve recorded information by means of light have come to be used markedly in other fields in recent years. The width of a groove for recording information of an optical disc is 0.5 μm, 1/100 that of an LP record with its groove width of 50 μm.

The size of the fine particles remaining on a stamper for molding a disc, that has been cleaned by the various cleaning methods mentioned above is 1 to 10 μm. The size of various kinds of dust or fine particles deposited by a stamper thereafter (during the molding of discs) is almost the same.

Accordingly, since a groove for recording information on a conventional stamper for molding LP records (for analog use) has a size of about 50 μm, as mentioned above, only cleaning at manufacturing time is needed.

On the other hand, since a groove for recording information on a stamper for molding optical discs (for digital use) is about 0.5 μm, even fine particles of 1 μm exert a disabling influence on information recording. In a stamper for molding optical discs, particularly, the grooves for recording information are narrow and near to each other. Therefore it is difficult to manufacture a stamper and it is expensive. A great number of optical discs must be molded using one stamper and storage for a long period of time is required.

A stamper for molding optical discs requires that cleaning be done because of dust or fine particles deposited during molding work or because of corrosion resulting from storage for a long period of time. Of course, to perform extraordinary cleaning of a stamper for molding optical discs with ease, the above electrodegreasing cleaning method and/or the ultrasonic cleaning method adopted in an ordinary stamper manufacturing process can be considered. However, it is difficult to increase the degree of effectiveness of cleaning one hundred-fold.

Also, making clean the entire work environment in which optical discs are molded can be considered. However, this requires that facilities for removing dust of 0.1 μm in a work room or for removing fine particles of the same size as those dispersed in the water used are needed. These facilities cannot but be large-scale, so this method is not practical.

SUMMARY OF THE INVENTION

A stamper cleaning apparatus of the present invention comprises an electrocleaning tank for performing electrocleaning a washing room adjacent to this cleaning tank, washing water spraying means disposed in the upper section of the washing room, for water-washing a stamper by spraying washing water onto the stamper while the stamper is positioned inside the washing room and is wet with the electrocleaning solution, water drain means disposed in the lower section of the washing room for collecting water after the stamper is washed with water and for draining it, and drying means disposed in the upper section of the washing room for drying the stamper after the above-mentioned washing water supply means has finished spraying during the predetermined time the stamper is held in the washing room.

That is, the present invention intends to increase the water washing effect greatly by an arrangement in which a electrocleaning tank is disposed along with a specific water washing room; washing water spraying means is disposed along with drying means in the washing room; and the washing water spraying means is operated while the stamper is positioned inside the washing room and is wet with an electrocleaning solution.

In the present invention, as the washing water spraying means capable of being adopted, a shower for spraying washing water, a sprayer or the like placed between an electrocleaning tank in which a stamper moves and a washing room in the upper section of the washing room can be preferably included. As the washing water, water, in which fine particles of about 0.2 μm or more are removed by using a filter such as a limit filter film of 0.1 μm, may be used and may be usually supplied to the abovementioned shower, sprayer or the like by means of a pump.

In the present invention, the washing water spraying means as mentioned above is operated so as to receive the spraying of washing water while the stamper is still wet with an electrocleaning solution after electrocleaning is finished. To be specific, to make it possible to spray washing water onto the stamper before the electrocleaning solution for the stamper has dried naturally, a shower, sprayer or the like may preferably be disposed in addition to a shower capable of spraying washing water onto the stationary stamper so that washing water can be sprayed while the stamper is moving from the electrocleaning tank to the washing room.

As the drying means capable of being adopted in the present invention, an infra-red ray heater, a fan capable of supplying hot air of about 30° to 50° C., in which dust or fine particles of 0.1 μm or more are removed, to a washing room or the like can be included. Preferably, an infra-red ray heater, from which dust or fine particles needed not be removed, can be included.

Seen from another viewpoint, an object of the present invention is to provide a stamper in which a sink and a work table are incorporated in the washing room; washing water supply means for supplying washing water to be sprayed onto the stamper is disposed in the upper section of the washing room; drying means is disposed above the work table; and clean air supply means for making air outside the washing room clean and supplying it to the inside of the washing room.

That is, the present invention intends to perform the following:

(i) The entire apparatus is made compact so as to be able to be placed inside an ordinary clean room;

(ii) Specific clean air supply means is disposed on the upper section of the washing room, which is one step higher than the clean room, so that a clean air area can be formed with ease;

(iii) Cleaning with washing water and drying can be performed in one-step higher clean air by placing the washing water supply means and the drying means in the clean air work area; so that The stamper can be cleaned with ease to a predetermined level of cleanliness by the above steps (i), (ii) and (iii).

The configuration of each means of the present invention will be explained hereinunder briefly.

The washing water supply means may be one capable of removing fine particles of about 0.1 μm or more in water and supplying the filtered water. To be specific, it may preferably be constructed to be able to shower de-ionized water via a semipermeable membrane (ultrafiltration membrane, reverse osmosis membrane, etc.)

The drying means may be means for drying a stamper cleaned with pure water. To be specific, a small drying room capable of making clean air inside or outside the washing room (for example, dust of about 0.1 μm or more is removed), heating the air and making it pass so as to be able to be brought into contact with the stamper can be cited as a preferable embodiment.

If examination means is disposed in the clean air work area, cleaning and drying can preferably be performed while examination is being performed. Here, the examination means refers to means for ascertaining whether or not a stamper has reached a predetermined level of cleanliness. To be specific, the examination means may preferably be a halogen lamp, a xenon lamp, an argon lamp or the like capable of irradiating the stamper with light. The examination means judges the presence or absence of dust, dirt or scratches by looking at the reflected light.

The clean air supply means refers to means, disposed in the upper section of the washing room, for making clean the air outside the washing room (for example, dust of about 0.1 μm or more is removed), and supplying it to the inside of the washing room. To be specific, as a second embodiment to be described later, a unit having a fan, a prefilter, and a filter can be included as a preferable embodiment.

These and other objects, features and advantages of the present invention will become clear when reference is made to the following description of the preferred embodiments of the present invention, together with reference to the accompanying drawings.

DETAILED DESCRIPTION OF THE PREFERRED EMBODIMENTS

The present invention will be explained in detail hereinunder with reference to a first and second embodiment. The present invention is not limited to these embodiments.

First Embodiment

Figure 1:
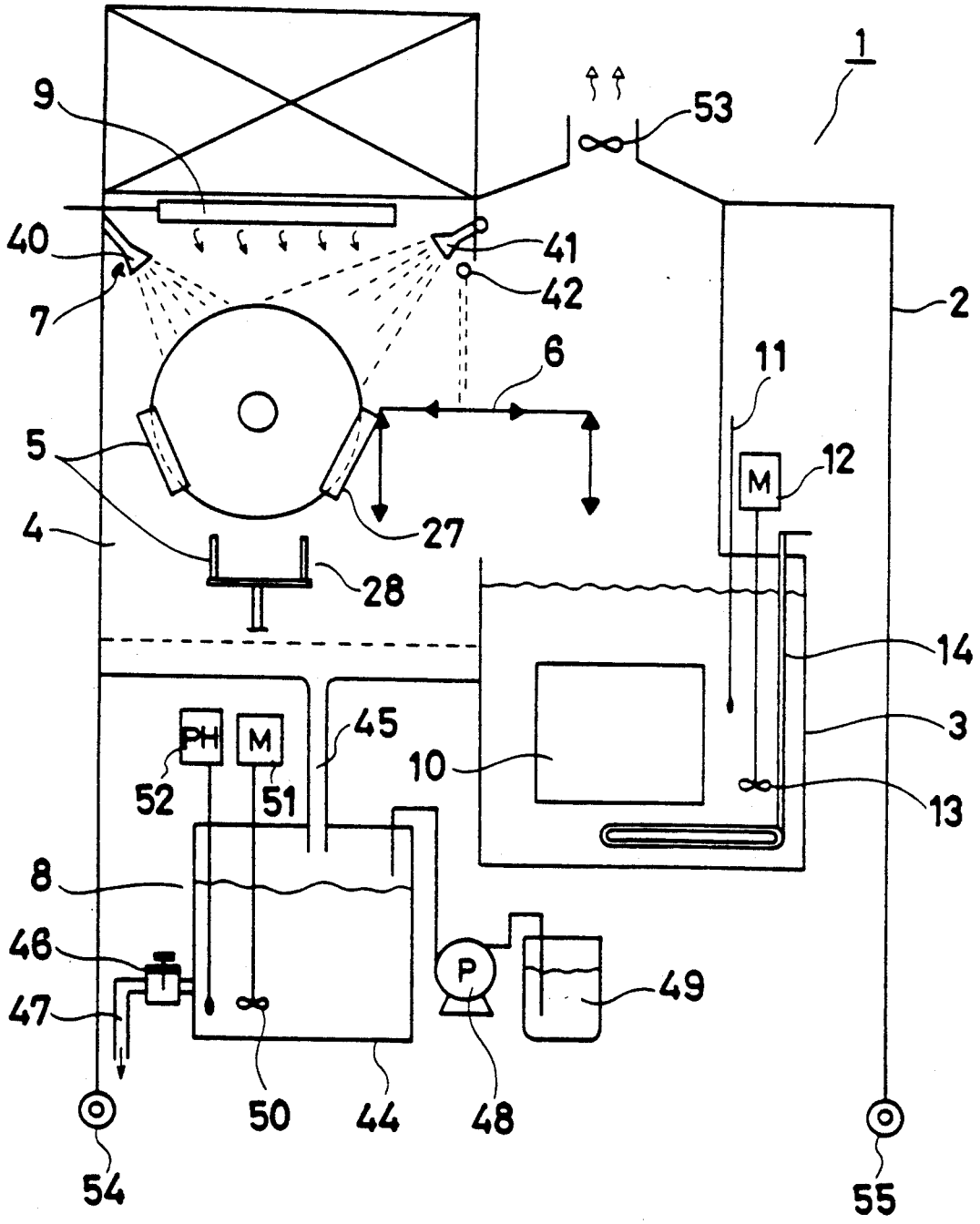
FIG. 1 is a schematic function-explaining view showing one embodiment of a stamper cleaning apparatus of the present invention.

First, in FIG. 1, a stamper cleaning apparatus 1 comprises an electrodegreasing cleaning tank 3 for performing electrodegreasing and a washing room 4 adjacent to the washing room in one frame main body 2 and further comprises mainly a stamper support 5 (cleaning electrode jig) movably disposed inside the frame main body 2, support movement means 6, washing water spraying means 7 disposed in the upper section of the washing room, water drain means 8, and heating means 9.

The electrodegreasing cleaning tank 3 is filled with a solution mixed with an alkali/surface active agent, and has an electrode board 10, a thermometer 11, a blade 13 for stirring an electrodegreasing solution that is rotated by means of a motor 12, and a heater 14. The descent of the liquid surface is detected by a liquid surface sensor (not shown) so as to keep the liquid level constant at all times.

Figure 2:
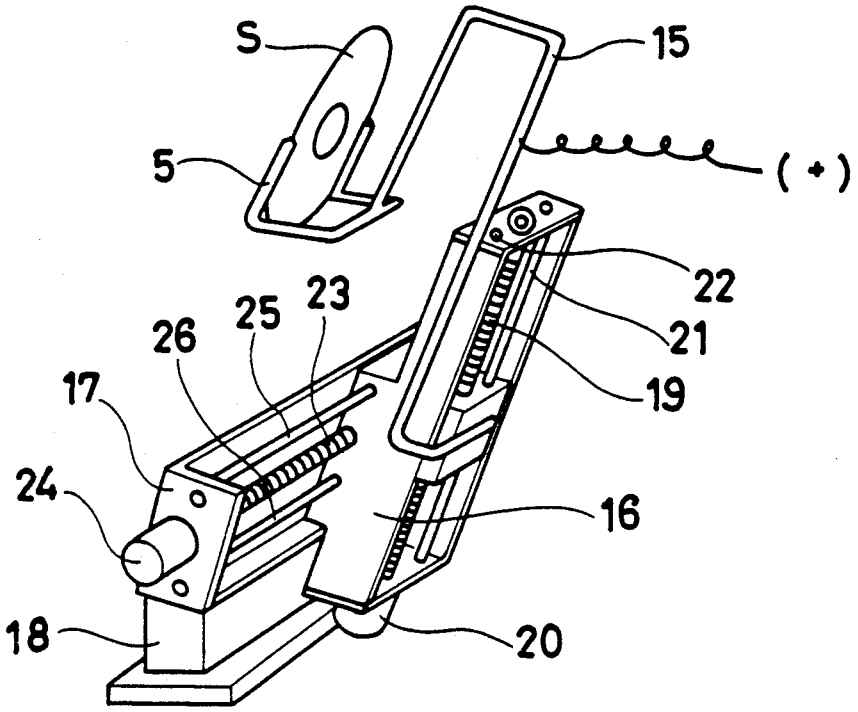
FIG. 2 is a perspective view of a support movement means of the stamper cleaning apparatus.

In FIG. 2, the support movement means 6 mainly comprises an angle 15 for holding the stamper support 5, a first moving platform 16 for obliquely movably supporting this angle upwardly and downwardly, a second moving platform 17 for horizontally movably supplying the first moving platform, and a base 18 for setting the second moving platform in the frame main body 2.

Numeral 19 denotes a screw axis, supported to the first moving platform 16, which is rotated by means of a motor 20. Numerals 21 and 22 denote guide axes. Numeral 23 denotes a screw axis which is rotated by means of a motor 24. Numerals 25 and 26 denote a guide axis.

Figure 5:
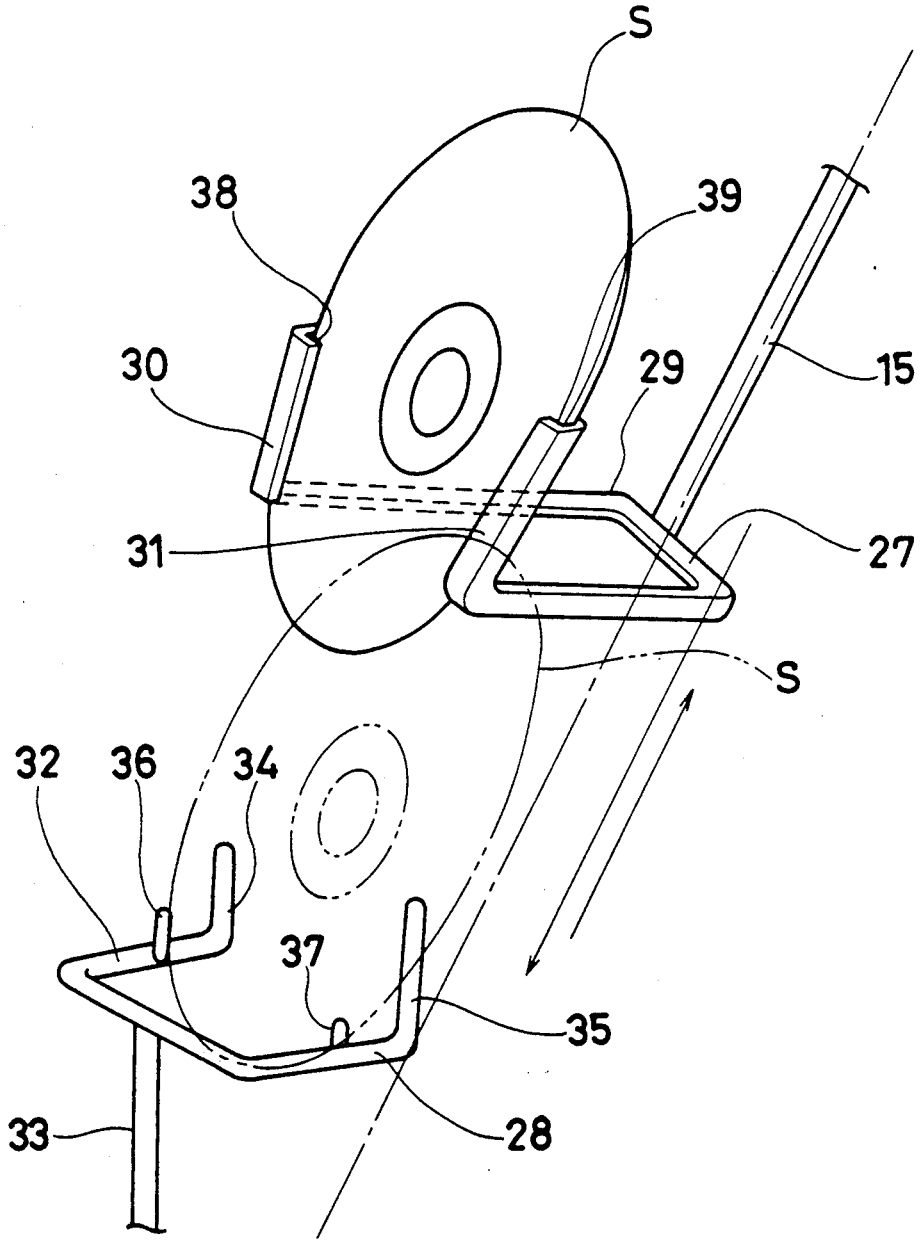
FIG. 5 is an explanatory perspective view explaining the relation between the movement section and the fixation section of the support.

The stamper support 5, particularly in FIG. 5, comprises a movement section 27 integrally supported by the angle 15 and a fixation section 28 suitably fixed inside the washing room 4. The movement section 27 comprises a U-shaped piece 29 and two inclination pieces 30 and 31 extending upwardly on an inclination from both ends of the U-shaped pieces.

The latter fixation section 28 includes a U-shaped piece 32, a base piece 33 for suitably fixing this U-shaped piece in the washing room 4, two large rise-up pieces 34 and 35 extending upwardly from both ends of the U-shaped piece, and two small rise-up pieces 36 and 37 extending upwardly in the middle of a piece oppositely facing the U-shaped piece 32.

The two inclination pieces 30 and 31 oppose each other and have recessed grooves 38 and 39, the space of which extends upwardly.

The washing water spraying means 7 comprises four main washing showers 40, 41 . . . placed in the four corners near the ceiling wall of the washing room 4 and two sub-washing showers 42 and 43 (not shown) placed oppositely facing to each other in the section between the electrodegreasing cleaning tank 3 and the washing room 4 near the ceiling wall. All the washing water sprayed by these showers is obtained by making de-ionized water pass through an ultrafiltration membrane (synthetic resin-made hollow type such as cellulose acetate, polyether sulfone, polysulfone, polyacrylonitrile) under pressure (about 1.5 atmospheres).

The water drain means 8 comprises a neutralization tank 44, a first water drained pipe 45 for supplying water drain from the washing room 4 to the neutralization tank 44, a second water drain pipe 47 extending, accordingly, from the neutralization tank 44 to a sewage pipe (not shown) via an electromagnetic opening and closing valve 46, a neutralization liquid supply tank 49 connected to the neutralization tank 44 via a pump 48 for supplying acids for neutralization (e.g., phosphoric acid, sulfuric acid, nitric acid of low concentration).

Numeral 50 denotes a blade, for stirring a liquid in the neutralization tank, which is rotated by means of a motor 51. Numeral 52 denotes a pH detector.

The heating means 9 comprises an infra-red ray heater disposed in the ceiling wall of the washing room 4. Numeral 53 denotes an air exhaust fan; numerals 54 and 55 denote casters.

Next, the operation of the stamper cleaning apparatus 1 constructed as mentioned above will be explained.

First, the stamper S is set on the moving platform 27 of the stamper support 5. That is, the outer circumference edge of the stamper S is fitted to the recessed grooves 38 and 39 of the two inclination pieces 30 and 31.

Next, when the start button of an operation panel (not shown) is pressed accordingly, each of the following means is automatically operated by an automatic control apparatus (not shown). That is, the motors 20 and 24 of the support movement means 6 are operated, causing the stamper S to move from the washing room 4 to the electrodegreasing cleaning tank 3 through paths ① and ② of FIG. 3.

The stamper S is held in the electrodegreasing cleaning tank 3 for about 5 to 6 min. and subjected to electrodegreasing cleaning.

Figure 3:
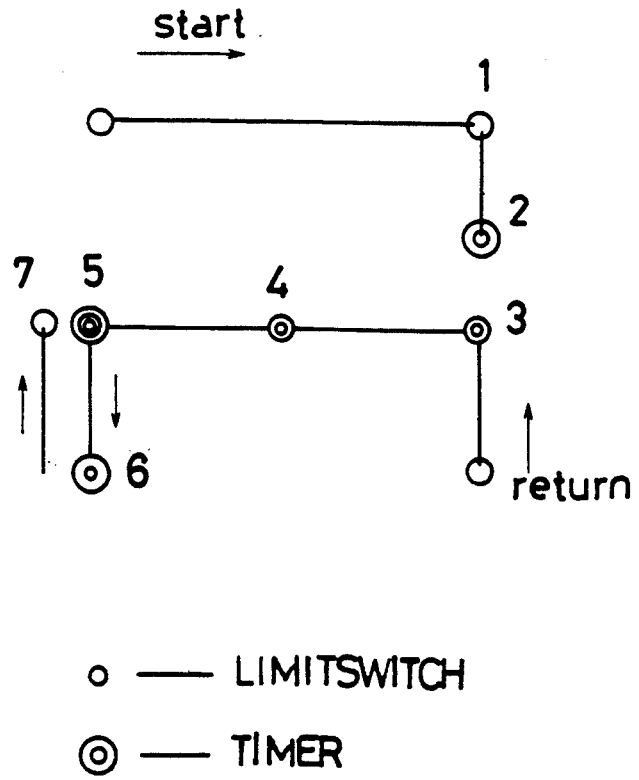
FIG. 3 is an explanatory view explaining the movement of the stamper support.
Figure 4:
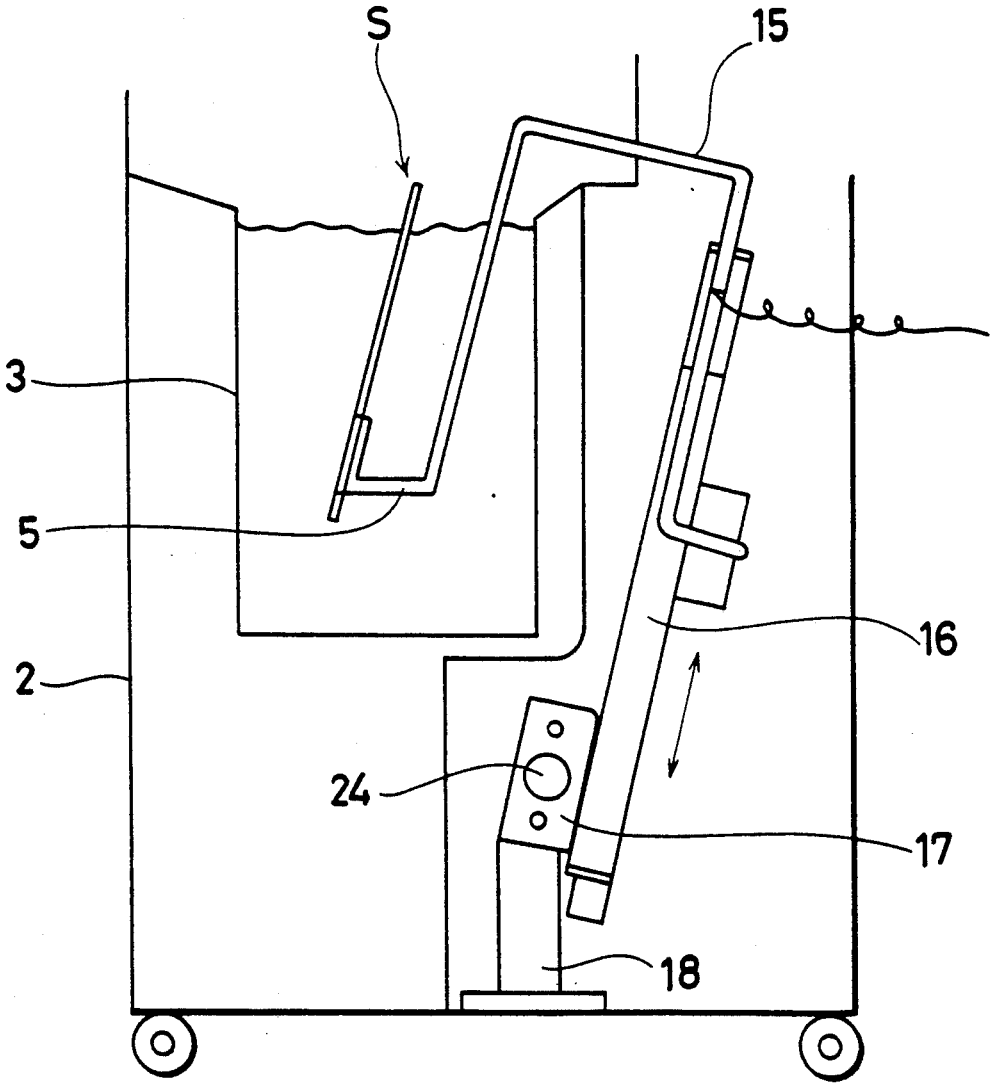
FIG. 4 is a schematic function-explaining view showing a state in which the stamper support is held inside the electrodegreasing cleaning tank.

Next, the motors 20 and 24 of the support movement means 6 are operated and move from path ③ of FIG. 3 to ⑥ through paths ④ and ⑤, causing the stamper S to move from the electrodegreasing cleaning tank 3 to the washing room 4. During this time, the sub-washing showers 42 and 43 operate to spray washing water onto the stamper S during movement before the electrodegreasing cleaning solution is dried. The stamper S is further held in the washing water for about 2 to 3 min. During this time, the main washing showers 40, 41 . . . operate to spray washing water onto the stamper S and to thoroughly wash off the remaining electrodegreasing cleaning solution.

Next, the heating means 9 is operated to heat and dry the stamper S with infra-red rays. The above series of jobs are finished and after the dried stamper S is taken out, a reset button (not shown) is pressed to return the movement section 27 of the stamper support 5 to the start position.

Since the stamper S obtained is subjected to cleaning in a state in which it is wet with the electrodegreasing solution, the washing effectiveness of the solution is high and extraordinary cleaning can be effected. When the electrodegreasing solution becomes dry once on the surface of the stamper S, fine particles in the solution are deposited and dried, causing stain defects which are very difficult to remove.

Washing water, which is collected in the bottom of the washing water tank after the stamper S is washed and which contains the electrodegreasing solution, is sent to the neutralization tank 44 via the first water drain pipe 45 where it is neutralized with the pH 7, and further drained accordingly via the second water drain pipe 47.

As has been described above, according to the stamper cleaning apparatus 1, the water-washing effect can be increased greatly by an arrangement in which a electrodegreasing cleaning tank and a washing room are disposed together so that the stamper can move; a washing water spraying means and a heating means are disposed in the washing room; and the washing water spraying means is made to operate while the stamper is positioned in the washing room and is wet with an electrodegreasing solution. That is, the problem in which fine particles in a solution are deposited on the surface of a stamper when it dries, and the removal of these fine particles is extremely difficult, can be solved.

Second Embodiment

Figure 6:
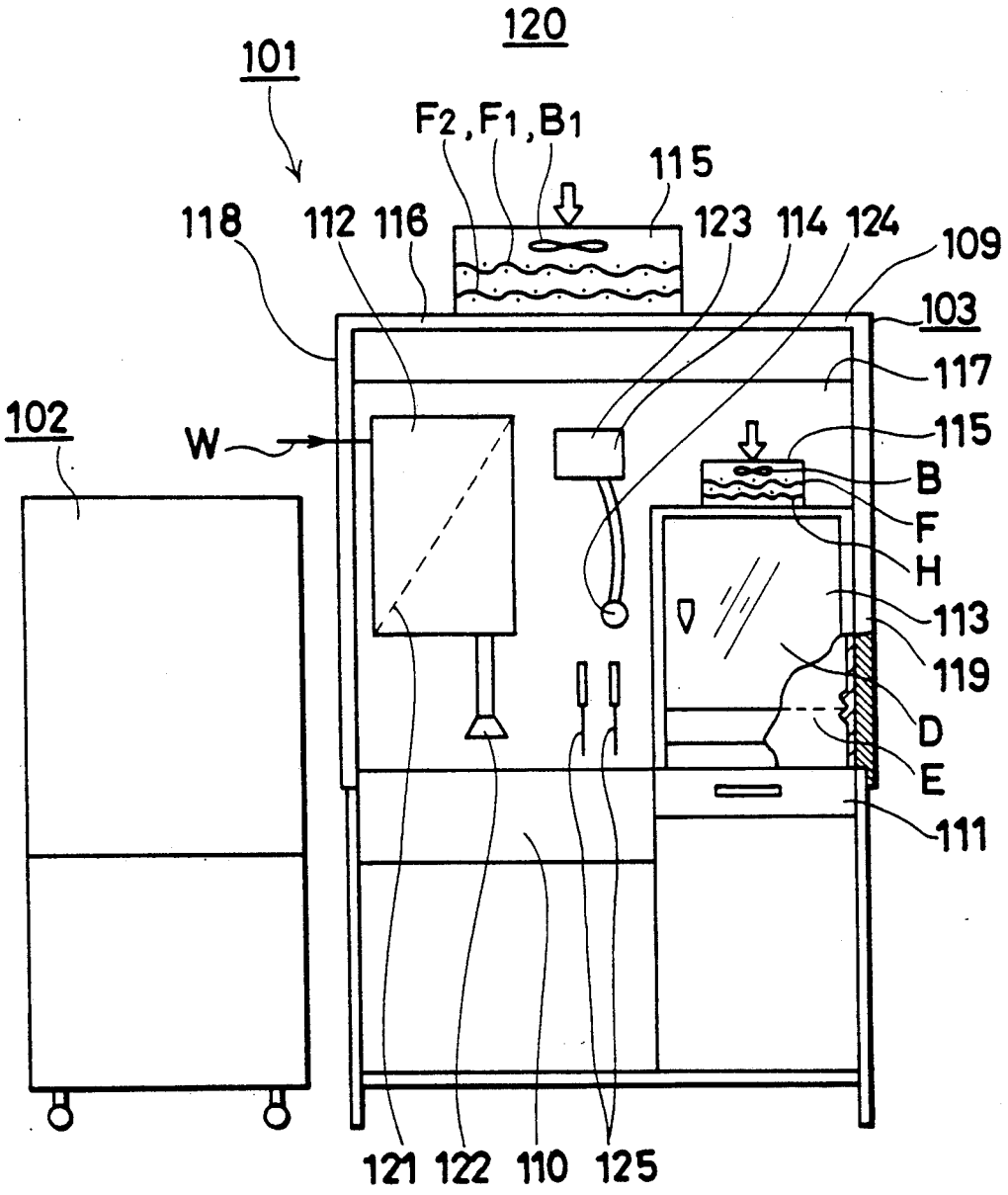
FIG. 6 is a configuration-explaining view showing another embodiment of the stamper cleaning apparatus of the present invention.

First, in FIG. 6, a stamper cleaning apparatus 101 is broadly composed of a main apparatus 102 employed as an electrodegreasing cleaning tank and an auxiliary apparatus 103 employed as a washing room separated from this main apparatus.

Figure 7:
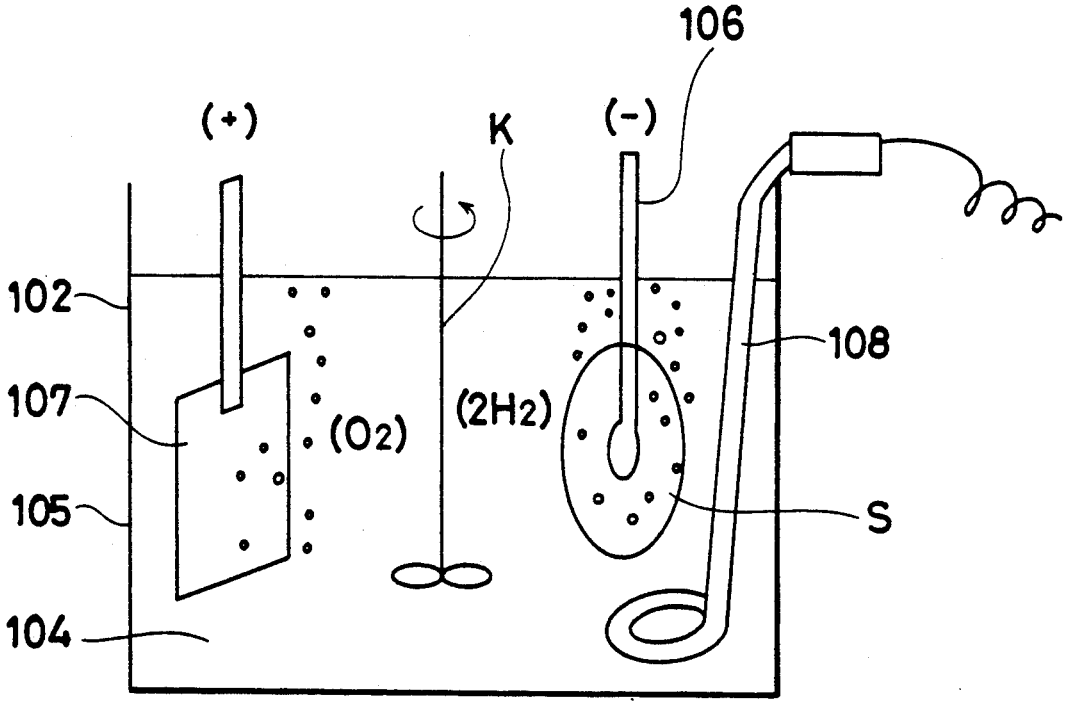
FIG. 7 is a function-explaining view of an electrodegreasing cleaning tank of the stamper cleaning apparatus.

In FIG. 7, the main apparatus 102 mainly comprises an electrolytic bath 105 filled with an alkali degreasing solution 104 as an electrolytic solution, a nickel metal cleaning jig (anode) 106 capable of suspending a nickel metal stamper S in an electrolytic solution, having the same workpiece as the stamper S, a nickel metal opposing electrode (cathode) 107 having also the same workpiece as the stamper S, a power supply (not shown), a heater 108, and an agitator K.

In FIG. 6, the auxiliary apparatus 103 mainly comprises a frame body 109, a sink 110 and a work table 111 incorporated in the lower section of the frame body, a shower 112, for supplying ultra-pure water, that is disposed above the sink 110 in the upper section of the frame body 109, a drying chamber 113 as a small drying room disposed above the work table 111 also in the upper section of the frame body 109, a halogen lamp irradiation apparatus 114, for examining a stamper, that is disposed between the drying chamber and the shower 112, and a clean air supply unit 115 for supplying clean air into the frame body 109.

The configuration of the auxiliary apparatus 103 will be explained in detail hereinunder.

The upper section and the lower section of the frame body 109 are formed so as to be able to be separated: the upper section is formed with a top plate 116, a shower 112, a drying chamber 113, and a back plate 117 on which an irradiation apparatus 114 is mounted, and transparent plates 118 and 119 both sides of which are made with synthetic resin; the lower section contains the sink 110 and the work table 111 which are integrally incorporated side by side, as mentioned above. As a result, a space that opens the front is formed in the frame body 109. Clean air from the clean air supply unit 115 is supplied into this space and a clean air area (clean bench), one step higher than the outside (clean room 120), is formed.

The shower 112 for supplying ultra-pure water comprises a de-ionized water supply source W, an ultrafiltration membrane (synthetic resin hollow type such as cellulose acetate, polyether sulfone, polysulfone, or polyacrylonitrile filler 121) for making all the supplied de-ionized water pass through under pressure (about 1.5 atmospheres), and a sprinkler outlet 122.

The drying chamber 113 contains an admission port above and an exhaust port E below. The drying chamber can supply air in the frame body 109 via a filter F and a heater (surface raw material workpiece: Teflon-processed stainless steel H) from the admission port by means of a fan B and exhaust it from the exhaust port E. If the door D in the front is opened and the stamper S is inserted, the stamper can contact with air which is made clean and heated.

The halogen lamp irradiation apparatus 114 for examining a stamper comprises a main body 123 and a light guide body 124 for condensing irradiation light from this main body and guiding it to a desired position.

The clean air supply unit 115 mainly comprises a fan $B_1$, a prefilter $F_1$, and a filter $F_2$. Numeral 125 denotes a jig for holding a stamper.

Next, a method of using the stamper cleaning apparatus 101 for molding optical discs constructed as above will be explained.

(i) Main apparatus 102

A stamper S to be cleaned is hooked to a cleaning jig 106 and suspended in an electrolytic solution. A DC voltage is applied between the cleaning jig 106 (anode) and an opposing electrode (cathode) 107 via a power supply. As a result, chemical and physical actions such as saponification, osmosis, dispersion, emulsification or the like, which gas generated furiously and an alkali degreasing solution have, act on the stamper S and the stamper S is cleaned effectively. The replacement of the alkali degreasing solution 104 should be performed when an accumulated time of electrical conductance has reached a predetermined value.

(ii) Auxiliary apparatus 103

The stamper S degreased and cleaned by the main apparatus 102 is taken out of the electrolytic bath 105 and is exposed to ultra-pure water by means of the shower 112 above the sink 110. The degree of washing (presence or absence of fine particles or dust remaining on the surface) is judged by irradiating by means of the photoconductor 124 of the irradiation apparatus 114 while adjusting the angle of the stamper S and by observing the reflected light. If the degree of washing is insufficient, ultra-pure water is applied again; if sufficient, the stamper S is inserted into the drying chamber 113, is brought into contact with air which is made clean and heated (example: 40° C.) and is dried.

Thus, a stamper having a desired level of cleanliness (remaining fine particles or dust: 0.1 μm or less) can be obtained. The auxiliary apparatus 103 can be divided into the upper section and the lower section. These divided upper and lower sections are designed so as to be able to be carried in and out of a clean room without destroying cleanliness by each of the divided upper and lower sections and therefore it is convenient.

As has been described, according to the stamper cleaning apparatus 101 for molding optical discs, a stamper can be washed with pure water in a clean air area one step higher than a clean room and dried by checking the degree of the washing, thereby enabling a stamper to be cleaned to a predetermined level of cleanliness with ease.

Many widely different embodiments of the present invention can be made without departing from the spirit and scope thereof, therefore it is to be understood that this invention is not limited to the specific embodiments thereof except as defined in the appended claims.

What is claimed is:

1. A stamper cleaning apparatus, comprising:

an electrocleaning tank for performing electrocleaning;

a washing room adjacent to this cleaning tank;

washing water spraying means, disposed in the upper section of the washing room, for water-washing a stamper by spraying washing water onto the stamper while the stamper is positioned inside the washing room and is wet with the electrocleaning solution;

water drain means, disposed in the lower section of the washing room, for collecting water after the stamper is washed with water and for draining the water; and drying means, disposed in the upper. section of the washing room, for operating to dry the stamper after the washing water supply means has operated during a predetermined time the stamper is held in the washing room.

2. A stamper cleaning apparatus according to claim 1, wherein the electrocleaning tank and the washing room are defined in one frame main body, further comprising a stamper support movably disposed in the frame main body and support movement means for moving this support, thereby causing the stamper to move from the washing room to the electrocleaning tank, maintaining it in the cleaning tank for a predetermined time, then moving it from the electrocleaning tank to the washing room, and maintaining it in the washing room for a predetermined time.

3. A stamper cleaning apparatus according to claim 2, further comprising washing water spraying means, movably disposed in the frame main body, which is capable of spraying washing water to a stamper that moves from the electrocleaning tank to the washing room.

4. A stamper cleaning apparatus according to claim 1, wherein the washing water spraying means is a shower or a sprayer for spraying washing water.

5. A stamper cleaning apparatus according to claim 1 wherein the drying means consists of an infra-red ray heater and a fan which is capable of supplying heated air heated by this heater.

6. , A stamper cleaning apparatus, comprising:

an electrocleaning tank for performing electrocleaning;

a washing room adjacent to this cleaning tank;

a sink and a work table incorporated in the washing room;

washing water supply means for supplying washing water to be sprayed to the stamper disposed above the sink;

drying means disposed above the work table; and clean air supply means for making air outside the washing room clean and supplying the air to the inside of the washing room.

7. A stamper cleaning apparatus according to claim 6, wherein the washing room includes examination means for examining the cleanliness of the stamper on any location of the washing room.

8. A stamper cleaning apparatus according to claim 6, wherein the examination means is a halogen lamp, a xenon lamp, or an argon lamp capable of irradiating the stamper with light and using the reflected light for judgment.

9. A stamper cleaning apparatus according to claim 6, wherein the drying means is a small drying room which is capable of making air inside or outside the washing room clean via a filter, heating the air so as to make it be in contact with the stamper.

10. A stamper cleaning apparatus according to claim 6, wherein the washing water spraying means is a shower for supplying de-ionized water to the stamper via a semipermeable membrane.

11. A stamper cleaning apparatus according to claim 10, wherein the semipermeable membrane is in a form of hollow fiber made of cellulose acetate, polyether sulfone, polysulfone, or polyacrylonitrile.

* * * * *